US007491078B2

(12) United States Patent
Little et al.

(10) Patent No.: US 7,491,078 B2
(45) Date of Patent: Feb. 17, 2009

(54) STACKED ELECTRICAL CONNECTOR

(75) Inventors: Terrance Little, York, PA (US); Tod M Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/796,586

(22) Filed: Apr. 26, 2007

(65) Prior Publication Data

US 2008/0268702 A1 Oct. 30, 2008

(51) Int. Cl.
*H01R 13/15* (2006.01)

(52) U.S. Cl. ..... 439/260

(58) Field of Classification Search ..... 439/260, 439/495, 541.5

See application file for complete search history.

(56) References Cited

U.S. PATENT DOCUMENTS 4,530,553 A * 7/1985 Aujla ..... 439/62
4,946,403 A 8/1990 Billman et al.
6,586,681 B2 * 7/2003 Adams et al. ..... 174/117 F
6,589,068 B2 7/2003 Yu

FOREIGN PATENT DOCUMENTS

JP 3222842 B 4/2000

* cited by examiner

*Primary Examiner*—Phuong K Dinh
(74) *Attorney, Agent, or Firm*—Wei Te Chung

(57) ABSTRACT

A stacked connector for flexible printed circuits (FPCs) includes a housing (1), two rows of terminals (20, 21) and an actuator (3) having a pressing portion (31). The housing defines a first and second receiving cavity (131,132) respectively for receiving one FPC in each cavity therein and a third receiving cavity (133) located between the first and the second receiving cavity. The terminal includes a contacting portion (203/213) with a contacting point (2031) and an actuating portion (2032/2132) thereon, the contacting points of two rows respectively project into the first and the receiving cavity and the actuating portions of the two rows both project into the third receiving cavity. The pressing portion is inserted into the third receiving cavity and presses the actuating portions of terminals to urge the contacting points to connect with the FPCs.

16 Claims, 7 Drawing Sheets

STACKED ELECTRICAL CONNECTOR

BACKGROUND OF THE INVENTION

1. Field of the Invention

The present invention relates to a stacked electrical connector, and more particularly to a stacked electrical connector for a sheet-like connection member such as a flexible printed circuit or cable (FPC), a flexible flat cable (FFC), a thin layer printed circuit board (PCB) and so forth. All of these cables and circuit will be generally referred to as "FPC" for simplification.

2. Description of Related Art

U.S. Pat. No. 6,589,068 with a same assignee of the present invention, discloses a stacked electrical connector, one above the other, for connection two FPCs thereto. The stacked connector includes an insulative housing with two longitudinal FPC-receiving slots, into which two rows of contacts protrude, and two actuators are inserted into the corresponding slots to press FPCs to engage contacts respectively.

Said stacked connector is of somewhat similar form to two conventional single connectors joined together by one above another and occupies a larger space (height direction) of object where the connector installed, such as PCB and electric component. Moreover, insertion of the lower FPC will interfere with the lower portion of the actuator, and insertion of the upper FPC will interfere with the upper portion of the actuator.

Hence, an improved stacked electrical connector is desired to overcome above problems.

SUMMARY OF THE INVENTION

An object of the present invention is to provide a simply stacked electrical connector.

Another object of the present invention is to provide a stacked electrical connector for in a simple insertion manner of FPCs.

In order to achieve above-mentioned object, a stacked connector for flexible printed circuits (FPCs) in accordance with the present invention includes comprises: an insulative housing defining at least a first and second receiving cavity respectively for receiving one FPC in each cavity therein and a third receiving cavity located between the first and the second receiving cavity; at least two rows of terminals loaded in the insulative housing, each terminal comprising at least one contacting portion with a contacting point and an actuating portion thereon, the contacting points of one row projecting into the first receiving cavity and the contacting points of another row projecting into the second receiving cavity, the actuating portions of at least two rows both projecting into the third receiving cavity; and an actuator comprising a pressing portion insertable into the third receiving cavity and pressing the actuating portions of terminals to urge the contacting points to connect with the FPCs.

Other objects, advantages and novel features of the present invention will become more apparent from the following detailed description of the present embodiment when taken in conjunction with the accompanying drawings.

DETAILED DESCRIPTION OF THE INVENTION

Figure 1:
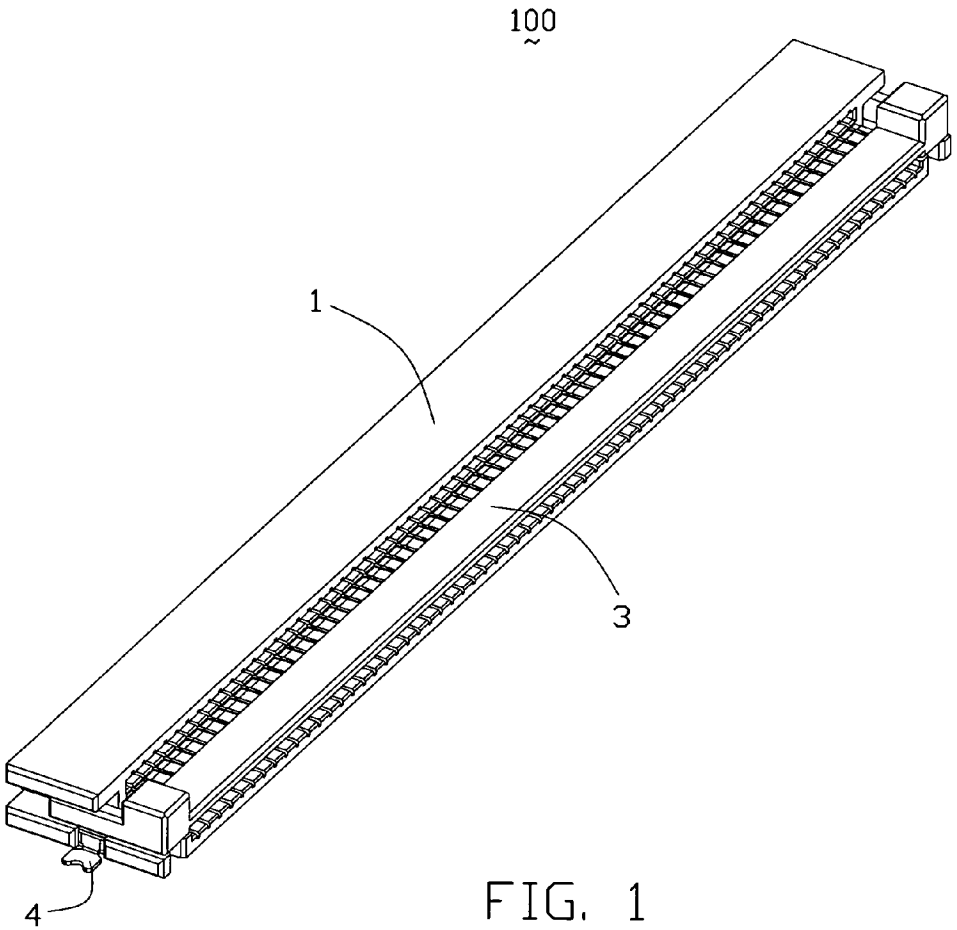
FIG. 1 is a perspective view of a stacked electrical connector in accordance with the present invention.

Reference will now be made to the drawing figures to describe the preferred embodiment of the present invention in detail.

Figure 4:
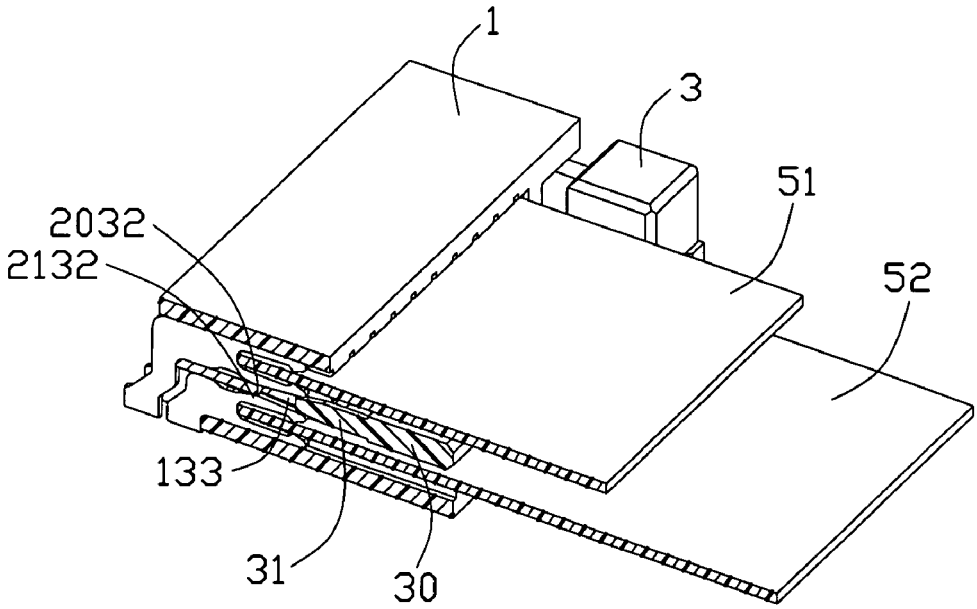
FIG. 4 is a partly assembled, exploded perspective view of the stacked connector, left half cut away and exploded, wherein the actuator is at the open position.

Referring to FIG. 1, a stacked electrical connector 100 for connecting FPCs 51, 52 (as shown in FIG. 4) in accordance with the present invention comprises an elongate housing 1, molded in one piece of insulative plastic, a series of terminals retained in the housing 1, and an actuator 3 installed into the housing 1.

Figure 2:
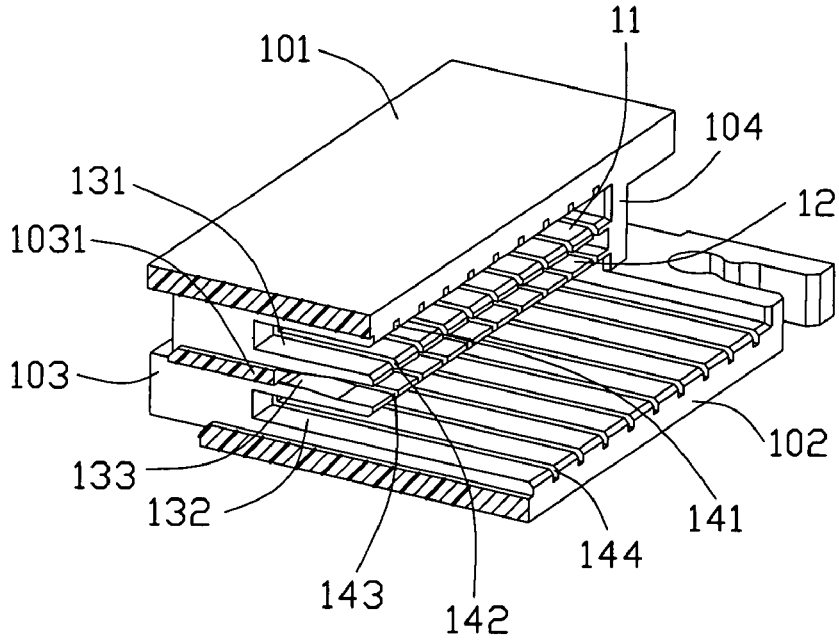
FIG. 2 is a perspective view of a housing of the stacked connector, left half cut away and exploded, mainly showing configuration of the housing.

As shown in detail in FIG. 2, the housing 1 is of substantially rectangular shape, formed by an upper sidewall 101, a lower sidewall 102, joined by a rear wall 103 and a pair of end walls 104. Two spaced tongue plate, an upper one 11 and a lower one 12, parallel extend forwards from an inner face of the rear wall 103 and joined with the end walls 104. The two tongue plates 11, 12 are aligned with the upper wall 101 and end walls 104 at front thereof, but the lower sidewall 102 protrudes forwards beyond them. A first receiving cavity 131 is defined between the upper sidewall 101 and the upper tongue plate 11 while a second receiving cavity 132 is defined between the lower tongue plate 12 and the lower sidewall 102 for respectively receiving one FPC in each cavity therein. Moreover, a third receiving cavity 133 is defined between the upper and the lower tongue plate 11, 12 for receiving the actuator 3, which will be described hereafter. The upper and the lower tongue plate 11, 12 are provided with a plurality of passageways 142, 143 penetrating through an upper and lower surface thereof, and the inner surface of both the upper and the lower sidewalls 101, 102 are provided with a plurality of passageways 141, 144. All of said passageways 141~144 run through the front face of the housing and the rear wall 103. And more, the rear wall 103 has a rib/partition 1031 projecting forward to the third receiving cavity 133.

Figure 3:
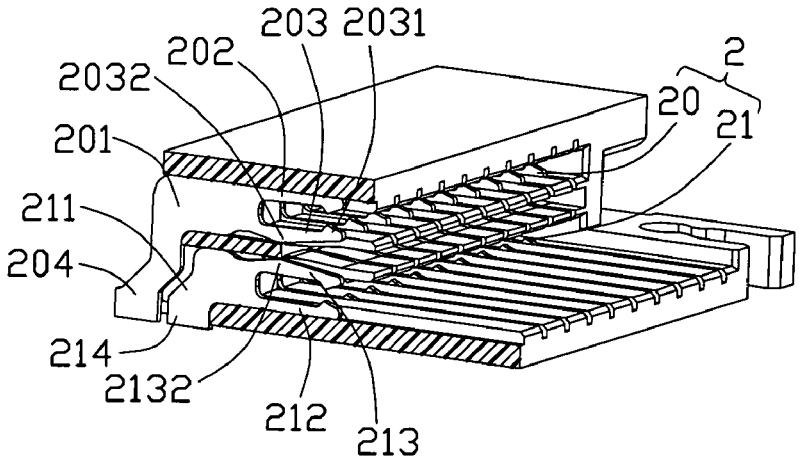
FIG. 3 is a perspective view of the housing with terminals therein, similar to FIG. 2.

Referring to FIGS. 2 and 3, the plurality of contacts 2 are formed with retaining portion or base portion 201/211 secured on rear wall 103 of the housing 1 and arranged into an upper row 20 and a lower row 21. Each contact 2 further includes a pair of contacting portions 202, 203/212, 213 extending forward from the retaining portion 201/211 along the corresponding passageway 141, 142/144, 143 with a contacting point respectively (only one contacting point 2031 is numbered) protruding face to face at each free end thereof, and a solder leg 204/214 extending downward out the housing from the retaining portion 201/211. Of the upper contact 20, the upper contacting portion 202 is cantilevered in the passageway 141 of the upper sidewall 101 from an upper portion of the front edge of retaining portion 201 and the lower contacting portion 203 is cantilevered in the passageway 142 of the upper tongue plate 11 from an opposite, a lower portion of the front edge of the retaining portion 201. The lower contacting portion 203 of the upper contact 20 has an actuating portion 2032 approximately in the middle thereof, which extrudes into the third receiving cavity 133, while the contacting points 2031 extrudes into the first receiving cavity 131. The lower contact 21 is similar to the upper contact 20 but an actuating portion 2132 is defined on the upper contacting portion 213 of the lower contact 21, instead of the lower contacting portion 203 of the upper contact 20, which also extrudes into the third receiving cavity 133. The actuating portions 2032, 2132 of both upper and lower contact 20, 21 are arranged face to each other. Each pair of contacting portions 202, 203/212, 213 extends in substantially parallel, coplanar relation and at a predetermined separation.

Figure 5:
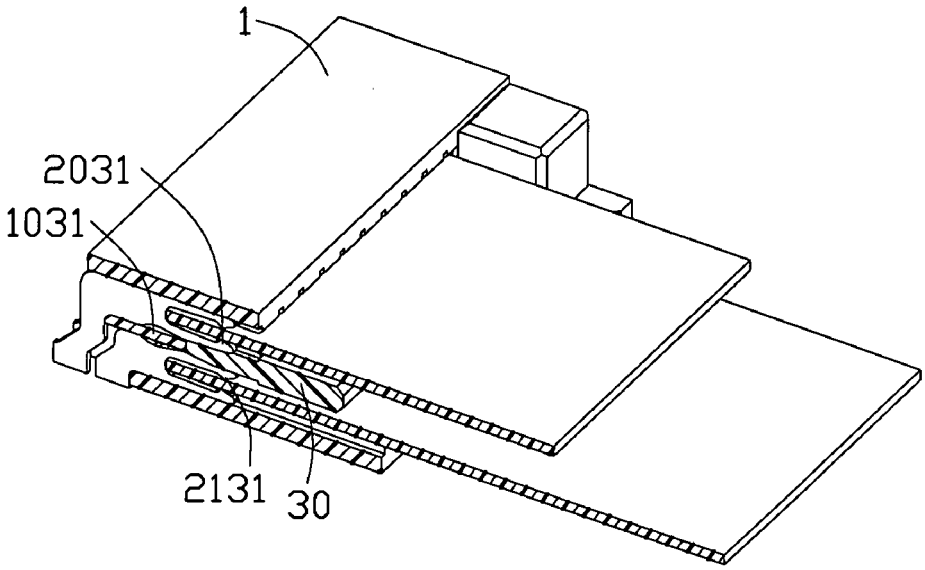
FIG. 5 is a view similar to FIG. 4, but the actuator is at the close position.

As best shown in FIGS. 4 and 5, when two FPCs 51, 52 are inserted in the first and second receiving cavities respectively i.e. between the contacting portion 202, 203/212, 213, a pressing portion 31 of the actuator 3 is inserted into the third cavity 133 and the pressing portion 31 presses the actuating portions 2032, 2132 respectively upwards and downward at same time, which will drive the contacting points 2031 upwards and downwards respectively to realize an engagement of terminals and electrical pads (not shown) of the FPCs.

Figure 6:
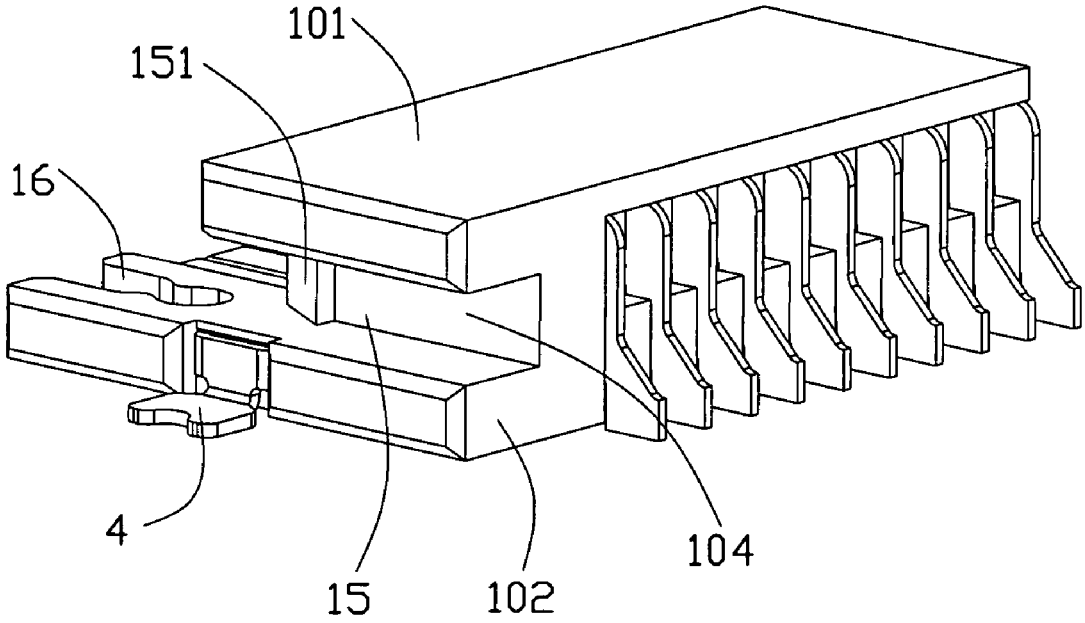
FIG. 6 is a view of the housing with the terminals of FIG. 3 but from another aspect, mainly showing the end wall of the housing.
Figure 7:
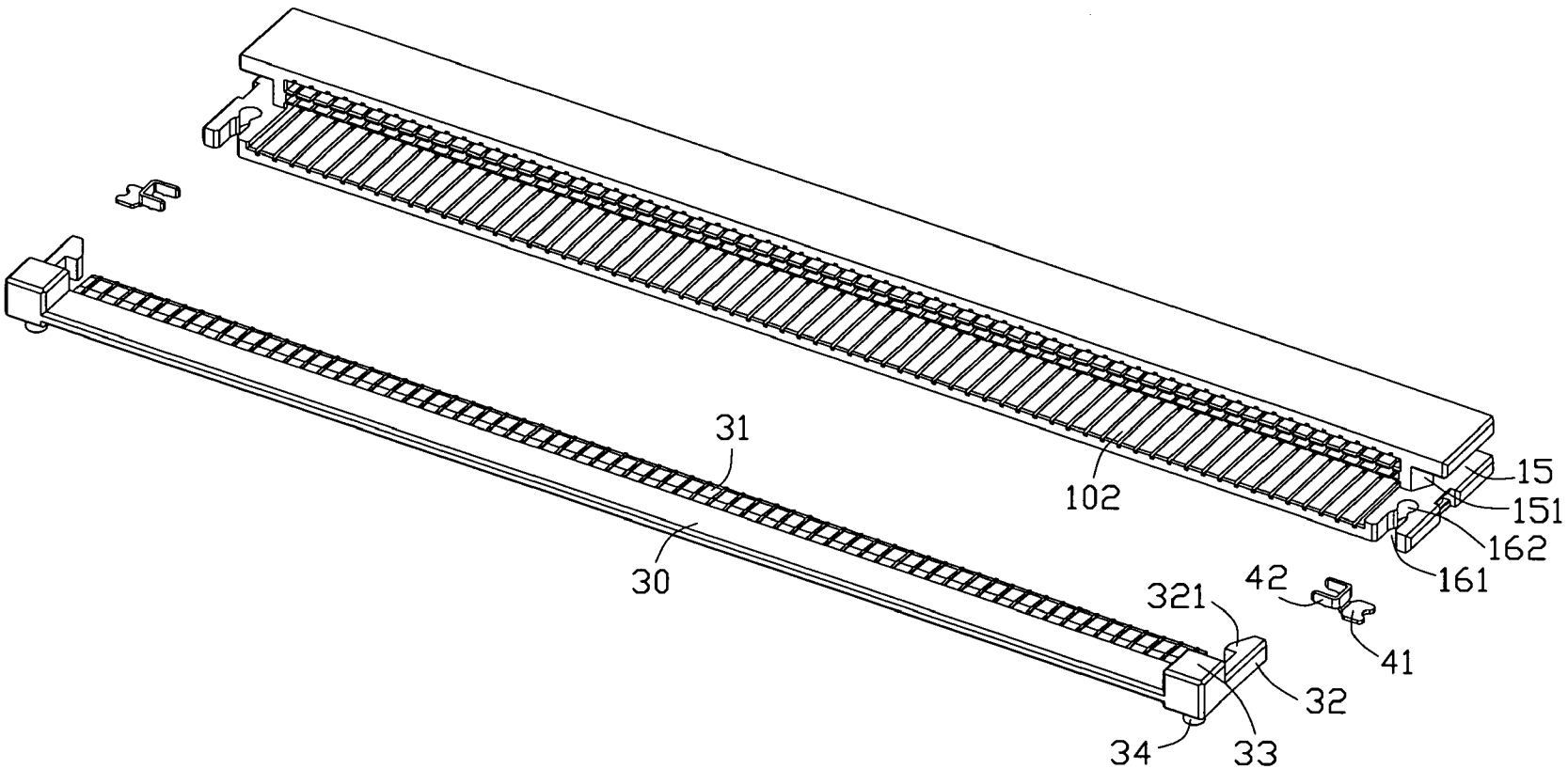
FIG. 7 is an exploded perspective view of the connector showed in FIG. 1.

Referring to FIGS. 6 and 7, a sliding recess 15 is defined with the upper and lower sidewall 102, 103 and the end wall 104 thereby at each longitudinal end of the housing and a stop protrusion 151 projects outwards at a front of the sliding recess 151. A guiding groove 16, through an upper and lower surface of the lower sidewall 102, is defined at the lower sidewall in front of the sliding recess 15 along the front-and-back direction since the lower sidewall 102 is beyond the upper sidewall 101 and the end walls 103. The guiding groove 16 is divided into two portions, a open portion 161 opened to the front edge of the lower sidewall 102 and a final portion 162 with a partial cylindrical shape communicating with and behind the open portion 161.

The actuator 3 is molded in one piece from insulating plastic with the central base portion 30 of predetermined length, the pressing portion 31 extending forwards from the base portion 30 and an arm portions 32 at respective opposite ends thereof. A pair of operating portions 33, which define said predetermined length and form an entry there between, is formed on opposite ends of the base portion 30 and said arm portions 32 extend forwards from the operating portion 33. Position protuberances 321, which protrude inwardly towards each other, are formed on opposed inner faces of the arm portions 32. A pair of guiding posts 34 with cylindrical shape extends downwards from operating portion 34.

Figure 8:
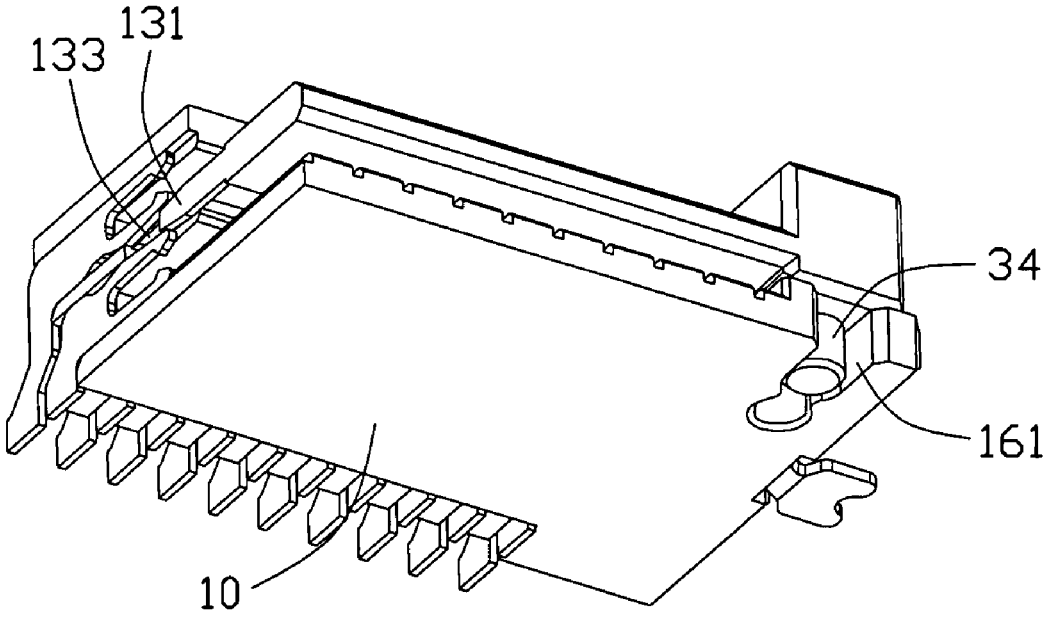
FIG. 8 is a perspective view of the connector, left half cut way and exploded, mainly showing the actuator and housing.

Referring to FIGS. 7 and 8, the actuator 3 is assembled with the insulating housing 1 from the front face by receipt of the pressing portion 31 in an front open of the third receiving cavity 133 while the position protuberance 321 of the arm portion 32, respectively are forced to ride over the stop protuberance 151 with resilient outward deformed of the arm portions 32 and the guiding post 34 are received in the open portion 161 of the guiding groove 16. Presently the actuator 3 is in an open position relative to the housing 1 to receive the FPCs.

Figure 9:
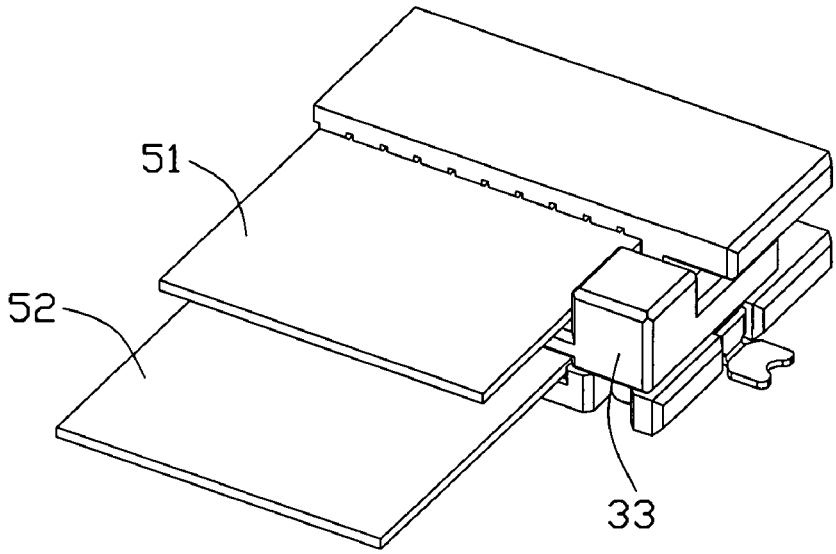
FIG. 9 is a partly assembled, exploded perspective view of the stacked connector, left half cut away and exploded, wherein the actuator is at the open position, mainly showing the actuator.
Figure 10:
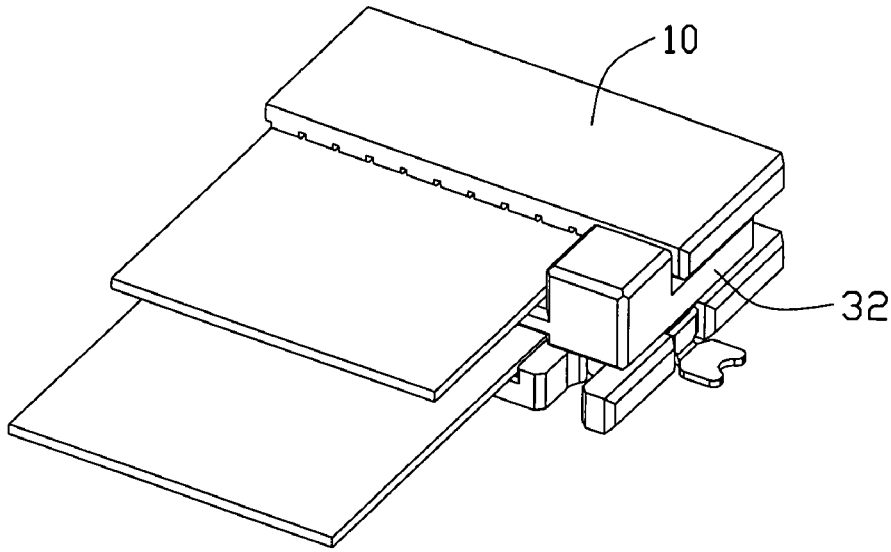
FIG. 10 is a view similar to FIG. 9, but the actuator is at the close position.

Referring to FIGS. 9 and 10 combined with FIGS. 4 and 5, after the FPCs 51, 52 are inserted into the first and second receiving cavities wherein the FPCs are respectively supported by the base portion 30 and the lower sidewall 102 (clear shown in FIG. 4), apply finger pressure to the operating portion 33 to urge the actuator 3 inwards until the pressing portion 31 is completely inserted into the third cavity 133, i.e. the front of the pressing portion contacts the rib 1031 (clear shown in FIG. 5), which is in a close position. In the close position, the guiding post 34 moves into the final portion 162 and the actuator is retained in the third cavity 133 by fiction between the pressing portion 31 and the contacting portions of the upper and lower contacts. The pressing portion 31 urges the contacting points of the contacts to engage the inserted FPCs as best shown in FIG. 5.

Referring to FIGS. 6 and 7, the connector further includes a pair of retaining members 4. The retaining member 4 has a solder tab 41 and retaining portions 42 used to be inserted into corresponding recess on the end wall of the housing.

Therefore the stacked connector 1 can receive two FPCs 51, 52, and by pressing the actuator 3 inward, will establish electrical connection of the two FPC's and corresponding contacts simultaneously, which will save space and assembly process of the actuator. Moreover, the lower FPC is readily inserted into the receiving cavity.

However, the disclosure is illustrative only, changes may be made in detail, especially in matter of shape, size, and arrangement of parts within the principles of the invention.

What is claimed is:

1. A stacked connector for flexible printed circuits (FPCs) comprising:

an insulative housing defining at least a first and second receiving cavity respectively for receiving one FPC in each cavity therein and a third receiving cavity located between the first and the second receiving cavity;

at least two rows of terminals loaded in the insulative housing, each terminal comprising at least one contacting portion with a contacting point and an actuating portion thereon, the contacting points of one row projecting into the first receiving cavity and the contacting points of another row projecting into the second receiving cavity, the actuating portion of the at least two rows both projecting into the third receiving cavity; and an actuator comprising a pressing portion insertable into the third receiving cavity and pressing the actuating portions of terminals to urge the contacting points to connect with the FPCs.

2. The stacked connector as described in claim 1, wherein the terminal comprises a pair of spaced contacting portions, said actuating portions are located on the contacting portion adjacent to the third receiving cavity.

3. The stacked connector as described in claim 1, wherein the terminal comprises a pair of spaced contacting portions, said actuating portions are located on the contacting portion adjacent to the third receiving cavity.

4. The stacked connector as described in claim 1, wherein two spaced and parallel tongue portion are located between said three receiving cavities and a plurality of passageways penetrates though the upper and lower surfaces of each tongue plates for receiving the terminals.

5. The stacked connector as described in claim 4, wherein the actuating portion locates in said passageways.

6. The stacked connector as described in claim 1, wherein the insulative housing defines a pair of sliding recesses at two opposite ends thereof and a pair of guiding grooves respectively in front of said sliding recesses, the actuator comprises a pair of arm portions slidable in the sliding recesses and a guiding portion shiftable in the guiding groove.

7. The stacked connector as described in claim 6, wherein the guiding portion is of post shape and the guiding groove divided into an open portion opened to a front edge of housing and a close portion communicating with the open portion and locating between the open portion and the sliding recess.

8. An electrical connector comprising:

an insulative housing defining at least two receiving cavities with tongue plates between two adjacent receiving cavities, the tongue plates define a plurality of passageways penetrating therethough to communicate with the two adjacent receiving cavities;

a plurality of terminals loaded in one of said two adjacent receiving cavities, each terminal comprising a contacting portion located in one of said passageways with a contacting point extending into said one receiving cavity and an actuating portion projecting into the other of said two adjacent receiving cavity; and an actuator comprising a pressing portion, wherein the pressing portion is movably inserted into the other of said two adjacent receiving cavity, and presses the actuating portion to urge the contacting point to further shift into said receiving cavity.

9. The electrical connector as described in claim 8, wherein the terminal further comprises another one contacting portion opposite said contacting portion and having a contacting point extending into said one receiving cavity.

10. A dual-port connector assembly, comprising:

an insulative housing defining two spaced mating ports therein;

two flexible circuit cables respectively received in the corresponding mating ports, respectively;

two sets of contacts respectively disposed in the housing with corresponding contacting sections extending into the corresponding mating ports, respectively; and a single actuator movably assembled to the housing to have, in each of the mating ports, one of the contacting section and the corresponding flexible circuit cable move toward to mechanically and electrically connect the other;

wherein in at least one of said mating ports, the contacting sections are closer to the actuator than the corresponding flexible circuit cable;

wherein the actuator directly abuts against the contacting sections in said at least one of the mating ports.

11. The dual-port connector assembly as claimed in claim 10, wherein the contacting sections and the corresponding flexible circuit cable in one of the mating ports are arranged in a mirror image manner with regard to those in the other of the mating ports.

12. The dual-pot connector assembly as claimed in claim 10, wherein the housing defines a truncated partition not only separating rear portions of said two mating ports but also leaving a space to allow communication between front portions of said two mating ports.

13. The dual-port connector assembly as claimed in claim 12, wherein said space receives a front portion of the actuator so as to allow a front portion of the actuator to invade the front portions of said mating ports.

14. The dual-port connector assembly as claimed in claim 10, wherein a front portion of the actuator is essentially located between the two mating ports when assembled.

15. The dual-port connector assembly as claimed in claim 10, wherein the actuator is slidable relative to the housing during assembly/disassembling.

16. The dual-port connector assembly as claimed in claim 10, wherein in said at least one of said mating ports, said contacting sections are essentially located by one side of the corresponding flexible circuit cable, while the corresponding set of contacts further include other contacting sections which are located by the other side of the corresponding flexible circuit cable and farther from the actuator than the corresponding flexible circuit cable.

* * * * *